US006335594B2

(12) United States Patent
Park

(10) Patent No.: US 6,335,594 B2
(45) Date of Patent: Jan. 1, 2002

(54) FRAME ASSEMBLY IN FLAT CATHODE RAY TUBE

(75) Inventor: Soo Kil Park, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/756,904

(22) Filed: Jan. 10, 2001

(30) Foreign Application Priority Data

Jan. 12, 2000 (KR) ..... 2000-1394

(51) Int. Cl.[7] ..... G09G 1/28
(52) U.S. Cl. ..... 315/1; 313/402; 313/407
(58) Field of Search ..... 315/364, 366, 315/370, 1; 313/421, 422, 364, 402, 407

(56) References Cited

U.S. PATENT DOCUMENTS 5,786,672 A * 7/1998 Date et al. ..... 315/368.26

6,163,104 A * 12/2000 Kimura ..... 313/421

* cited by examiner

*Primary Examiner*—David Vu
(74) *Attorney, Agent, or Firm*—Fleshner & Kim, LLP

(57) ABSTRACT

Frame assembly in a flat cathode ray tube, the flat cathode ray tube including a panel glass 1 having a fluorescent material coated on an inside surface, a funnel glass 2 fixed to rear of the panel glass 1 having a neck portion formed as one unit with an electron gun sealed therein for emission of electron beams 6 toward the fluorescent material, a deflection yoke 5 fitted on an outer circumference of the neck portion for deflection of the electron beams 6 emitted from the electron gun, a shadow mask 3 fitted to an inside surface of the panel glass 1 having a plurality of apertures for selecting colors, and a frame assembly 7 having a main frame 7*a* fitted to the shadow mask 3 and a subframe 7*b* connecting both ends of the main frame 7*a,* wherein a ratio of second moment of inertia(Ixx/Izz) of the subframe 7*b* is designed to be within 0.5~2.7 for avoiding a resonance between the frame assembly 7 and the shadow mask 3, thereby preventing occurrence of howling, effectively.

3 Claims, 9 Drawing Sheets

1st mode(120Hz) 2nd mode(170Hz)

2nd mode(170Hz) 4th mode(170Hz)

FRAME ASSEMBLY IN FLAT CATHODE RAY TUBE

BACKGROUND OF THE INVENTION

1. Field of the Invention

The present invention relates to a flat cathode ray tube, and more particularly, to a frame assembly in a flat cathode ray tube, which can prevent howling, a mask vibration, occurred when a frame assembly and a shadow mask are resonant 2. Background of the Related Art Referring to FIGS. 1 and 2, the flat cathode ray tube is provided with a panel glass 1, a shadow mask 3 fixed to a rear face of the panel glass 1 with a pre-tension having numerous apertures of circular or slot forms for selection of colors, a magnetic shield 9 fixed to an inside surface of the panel glass 1 for shielding electron beams 6 so that a path of the electron beams 6 are not deviated by an external geomagnetic field or a leakage magnetic field, a funnel glass 2 fixed to the panel glass I with frit glass having a neck portion formed as one unit in a rear portion thereof, an electron gun sealed in the neck portion of the funnel glass 2 for emitting R, G, B three color electron beams 6, and a deflection yoke 5 DY mounted to surround an outer surface of the neck portion for deflecting the electron beams 6.

In the meantime, since the flat cathode ray tube is susceptible to an external impact owing to an internal high vacuum, the panel glass 1 is designed to withstand the atmospheric pressure. And, there is a reinforcing band 11 strapped around a skirt portion of the panel glass I for spreading a stress in the cathode ray tube under a high vacuum to secure an impact resistance.

In the operation of the flat cathode ray tube, the electron beams 6 from the electron gun in the neck portion of the funnel glass 2 are made to hit onto fluorescent material surface 4 on an inside surface of the panel by an anodic voltage provided to the cathode ray tube, when the electron beams 6 are deflected in an up, down, right, or left direction by the deflection yoke 5 before the electron beams 6 reach to the fluorescent material surface 4. There are 2·4·6 polar magnets 10 in rear of the neck portion for correcting a path of travel of the electron beams 6 so that the electron beams 6 can hit onto an intended fluorescent material and prevent occurrence of defective color purity.

In the meantime, referring to FIGS. 2 and 3, the shadow mask 3 in the flat cathode ray tube is provided with an effective area 3 a having the numerous apertures, and an edge portion 3*b* without the apertures for reinforcing a strength of the effective area 3*a*. The shadow mask 3 is prestressed in up and down directions with a tension P1. That is, in the related art, the application of the tension P1 to the shadow mask 3 by the frame assembly designed to have a high rigidity makes the shadow mask 3 resonant at a high frequency, thereby preventing howling in which the shadow mask 3 vibrates. The frame assembly 7 has a main frame 7*a* fitted to both ends of the shadow mask 3 directly, and a subframe 7*b* fitted across the main frame 7*a*. There is a spring 8 fitted to the main frame 7*a* for fixing the frame assembly on an inside surface of the panel glass 1.

However, the welding of top and bottom edges 3*b* of the shadow mask 3 to the main frame 7*a* to exert the tension to the shadow mask 3 causes an intense vibration of the shadow mask 3 owing to resonance with the frame assembly 7 when an external vibration is transmitted to the shadow mask 3, resulting in a beam landing error, that causes howling, in which the electron beams from the electron gun can not hit onto the fluorescent material film exactly. That is, as shown in FIGS. 4~5, while natural frequencies of the shadow mask 3 are distributed closely at a frequency range over 150 Hz continuously, as shown in FIGS. 6 and 7, a first natural frequency of the frame assembly occurs at 120 Hz in a twisting mode, and a second natural frequency of the frame assembly occurs at 170 Hz in a shearing mode. Consequently, though the shadow mask 3 is not resonant with the frame assembly 7 at the first vibration mode of twisting mode, as shown in FIGS. 4 and 7, the shadow mask 3 is resonant with the frame assembly 7 at the second vibration mode of shearing mode, because natural frequencies of the shadow mask 3 and the frame assembly 7 are the same. In summary, in the related art, the intense vibration of the shadow mask 3, a color selection electrode, owing to resonance between the frame assembly 7 and the shadow mask 3 caused by an external vibration results in a beam landing error in which the electron beams from the electron gun can not hit the fluorescent material exactly, that in turn causes howling, a vibration of the picture.

SUMMARY OF THE INVENTION

Accordingly, the present invention is directed to a frame assembly in a flat cathode ray tube that substantially obviates one or more of the problems due to limitations and disadvantages of the related art.

An object of the present invention is to provide a frame assembly in a flat cathode ray tube, in which a second moment of inertia of a subframe forming a frame assembly with a main frame is optimized for preventing occurrence of howling of the shadow mask, a vibration of the shadow mask, caused by resonance between the frame assembly and the shadow mask, and minimizing weight of the frame assembly.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the frame assembly in a flat cathode ray tube, the flat cathode ray tube includes a panel glass having a fluorescent material coated on an inside surface, a funnel glass fixed to rear of the panel glass having a neck portion formed as one unit with an electron gun sealed therein for emission of electron beams toward the fluorescent material, a deflection yoke fitted on an outer circumference of the neck portion for deflection of the electron beams emitted from the electron gun, a shadow mask fitted to an inside surface of the panel glass having a plurality of apertures for selecting colors, and a frame assembly having a main frame fitted to the shadow mask and a subframe connecting both ends of the main frame, wherein a ratio of second moment of inertia(Ixx/Izz) of the subframe is designed to be within 0.5~2.7 for avoiding a resonance between the frame assembly and the shadow mask, thereby preventing occurrence of howling, effectively.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
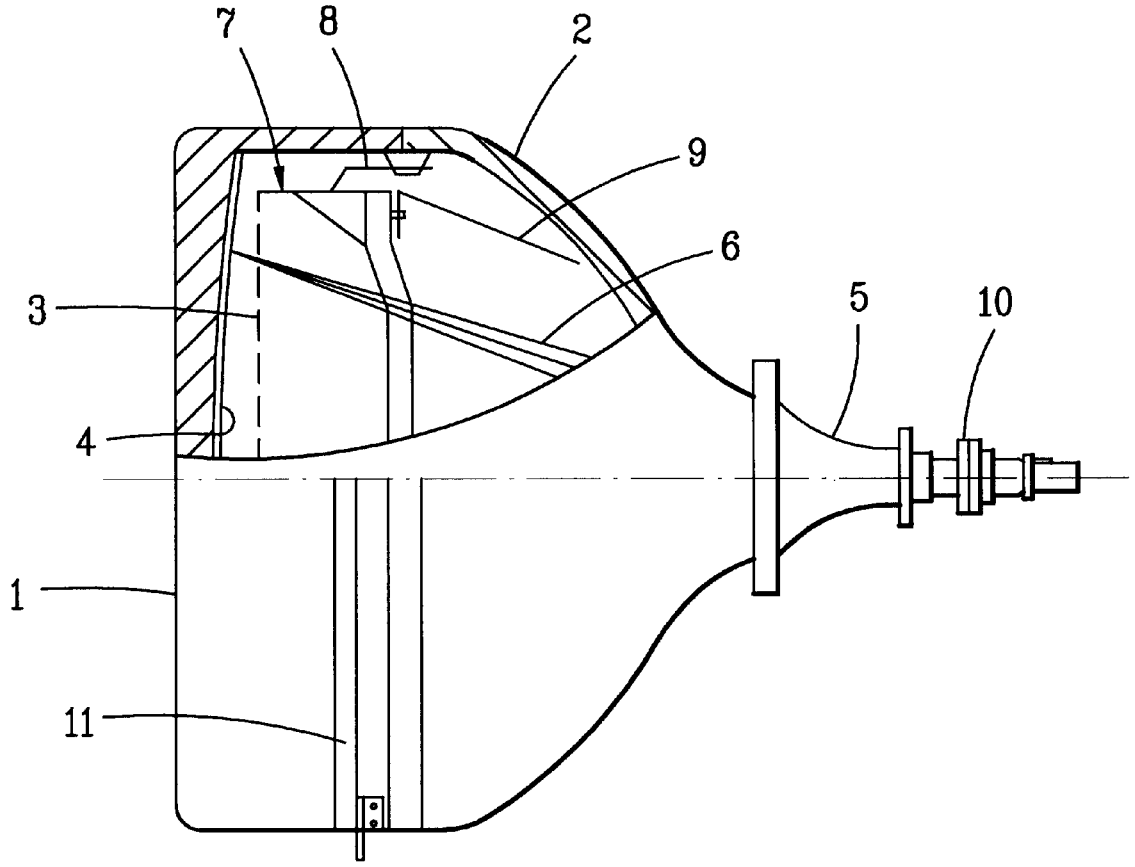
FIG. 1 PRIOR ART
FIG. 1 illustrates a side view with a partial cut away view of a related art flat cathode ray tube.
Figure 2:
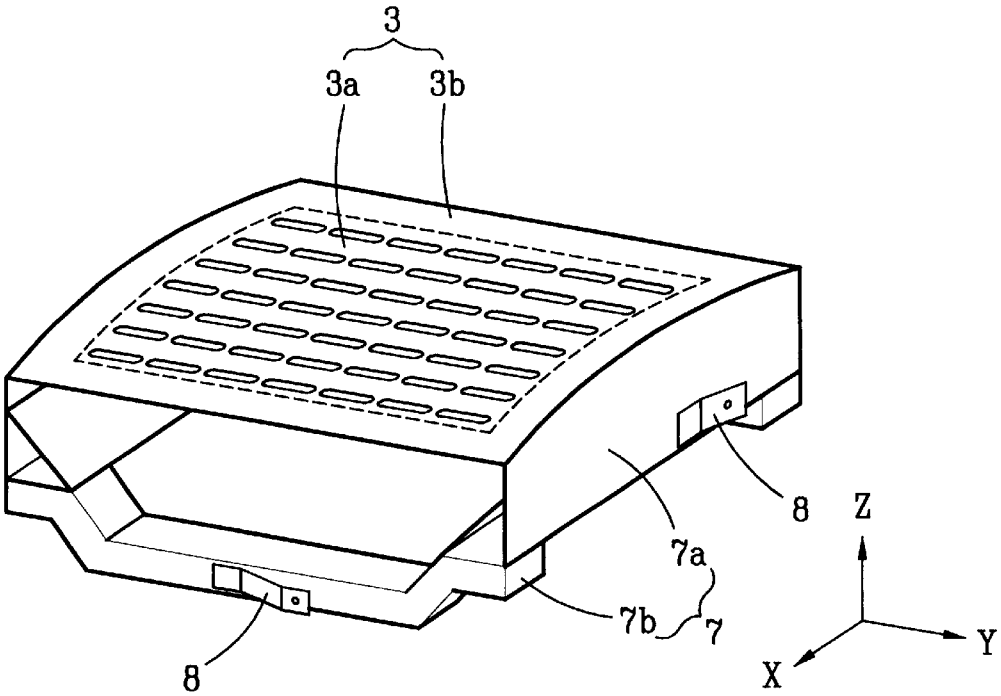
FIG. 2 PRIOR ART
FIG. 2 illustrates a perspective view of a mask assembly, a key part, in FIG. 1.
Figure 3:
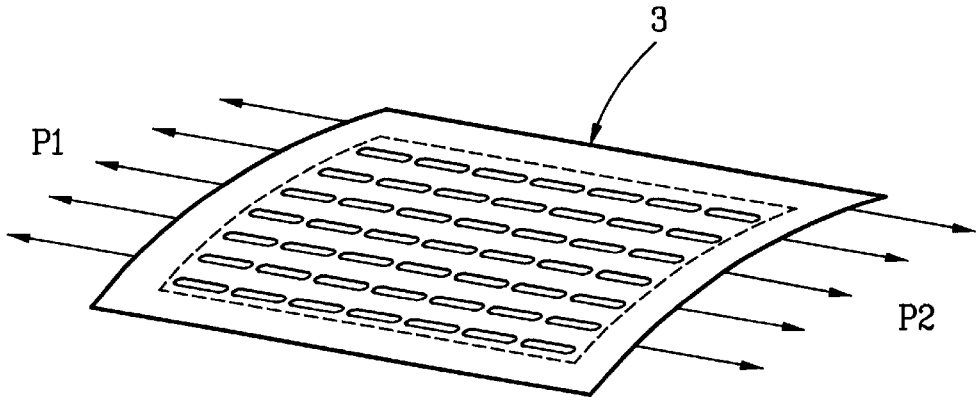
FIG. 3 PRIOR ART
FIG. 3 illustrates a shadow mask with a tension applied thereto, schematically.
Figure 4:
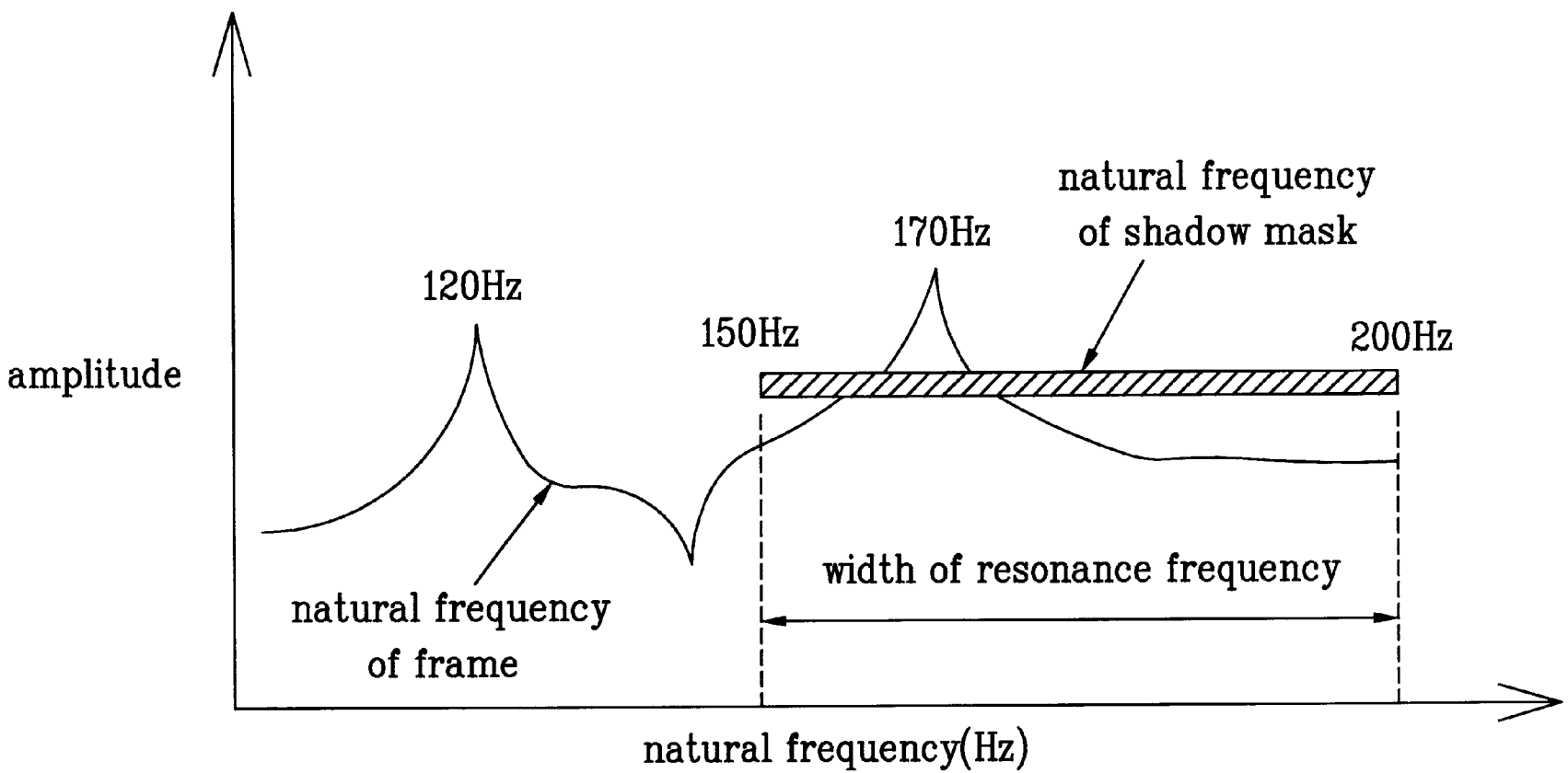
FIG. 4 PRIOR ART
FIG. 4 illustrates a graph showing a comparison of resonance frequency ranges of the frame assembly and the shadow mask in the related art.
Figure 5:
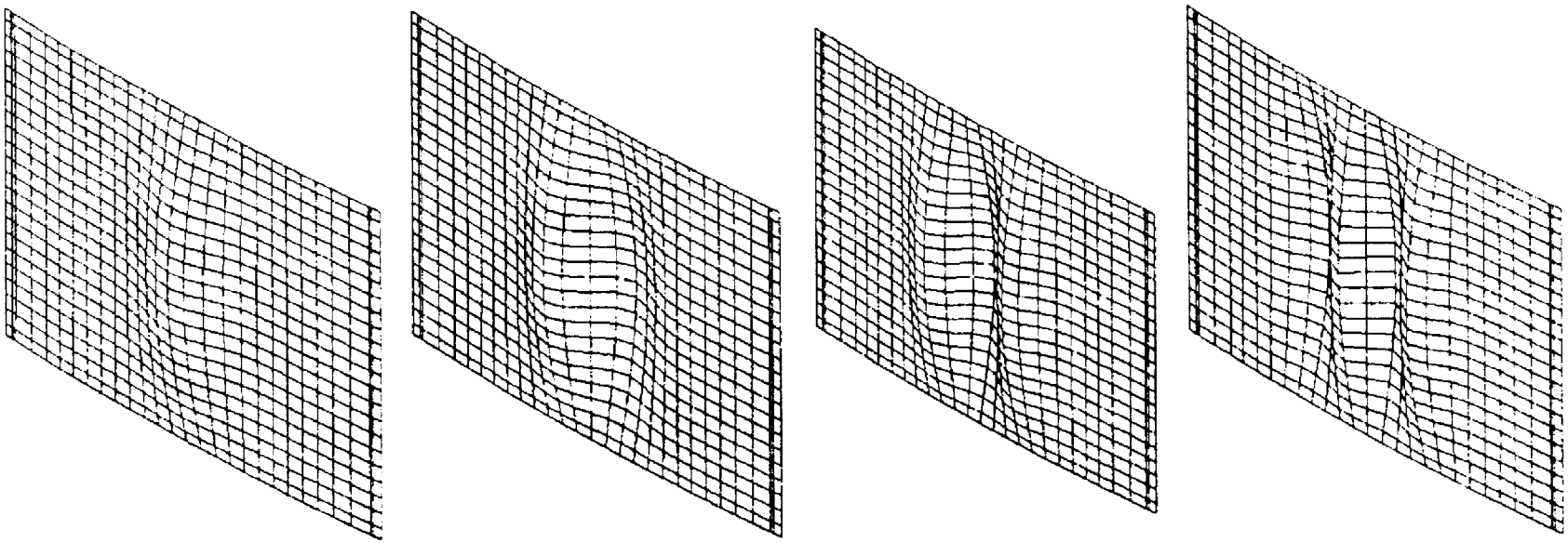
FIG. 5 PRIOR ART
FIG. 5 illustrates analyses of vibration modes for natural frequencies of a shadow mask.
Figure 6:
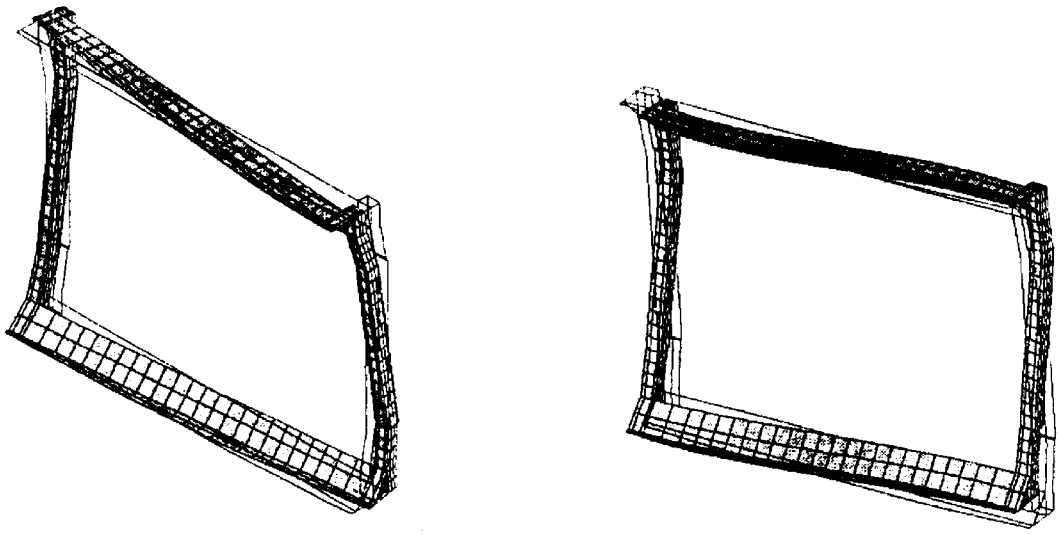
FIG. 6 PRIOR ART
FIG. 6 illustrates analyses of vibration modes for natural frequencies of a frame assembly.
Figure 7:
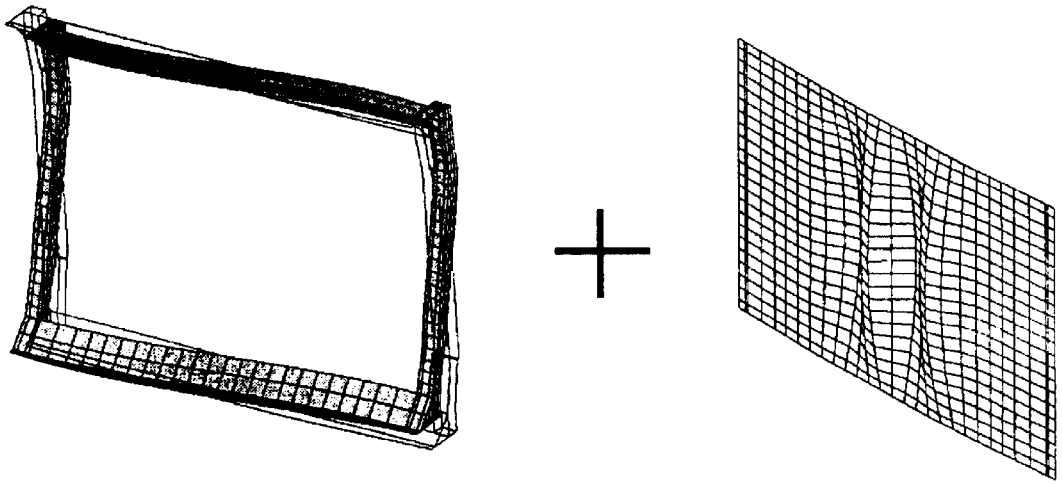
FIG. 7 PRIOR ART
FIG. 7 illustrates vibration mode analyses at a resonance mode of a shadow mask and a frame assembly.
Figure 8:
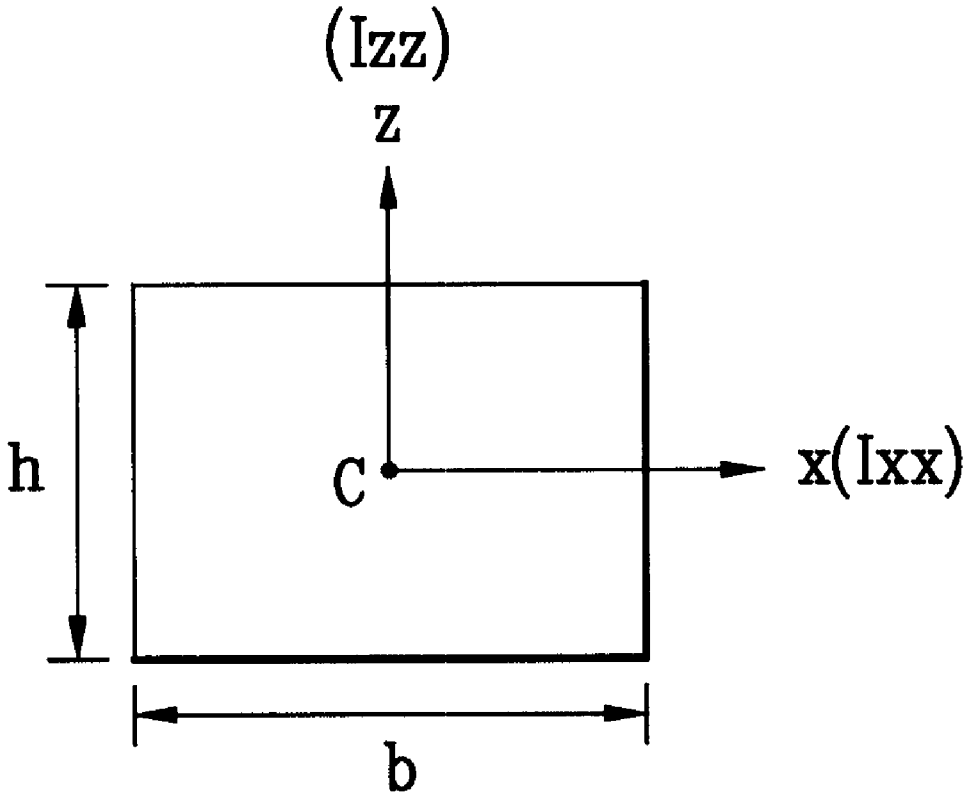
FIG. 8 illustrates a solid rectangular section of a subframe with inertial coordinate axes set thereon.
Figure 9:
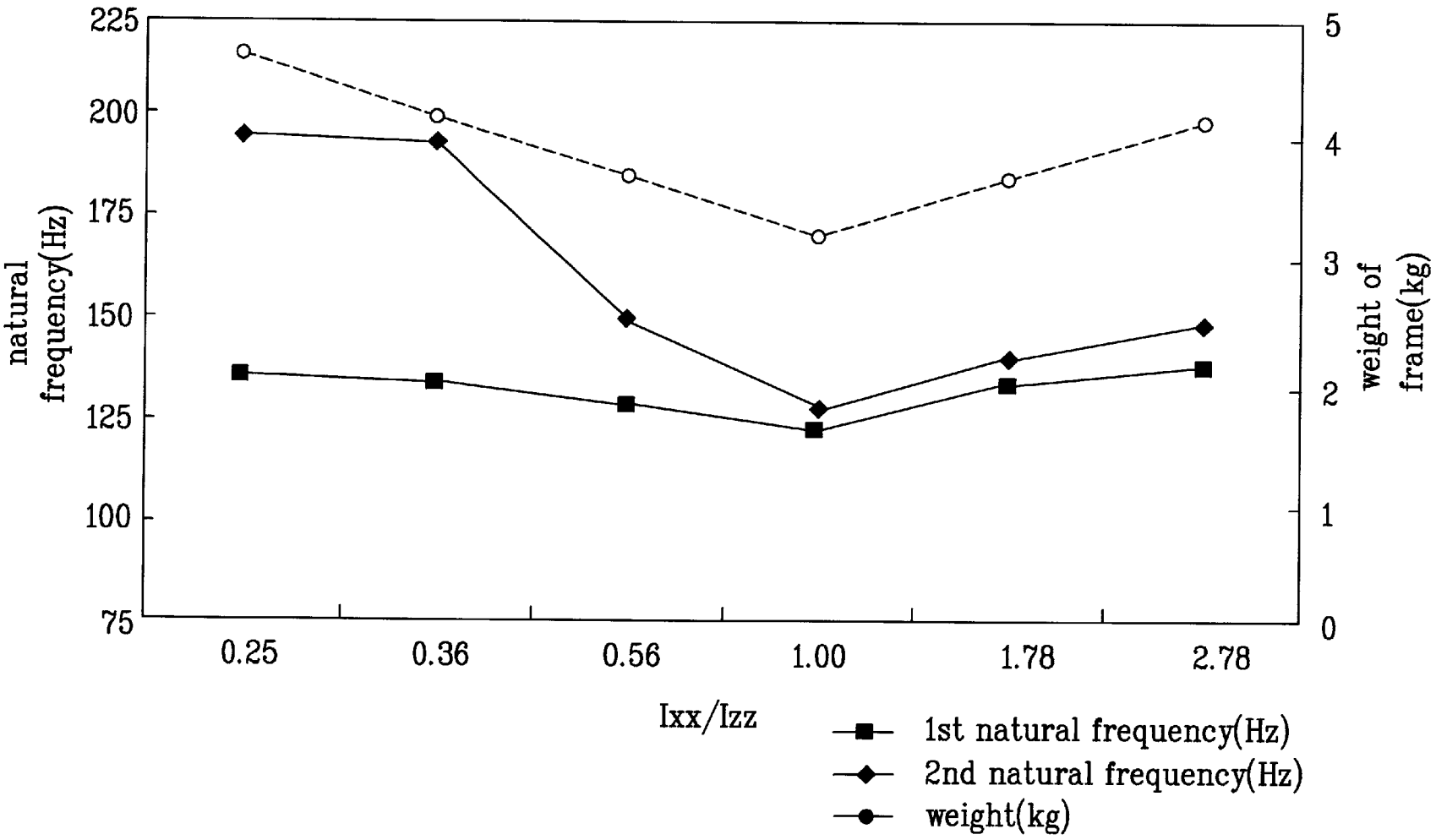
FIG. 9 illustrates a graph showing a ratio(Ixx/Izz) of second moment of inertias of a subframe versus natural frequency and weight of the frame assembly.
Figure 10:
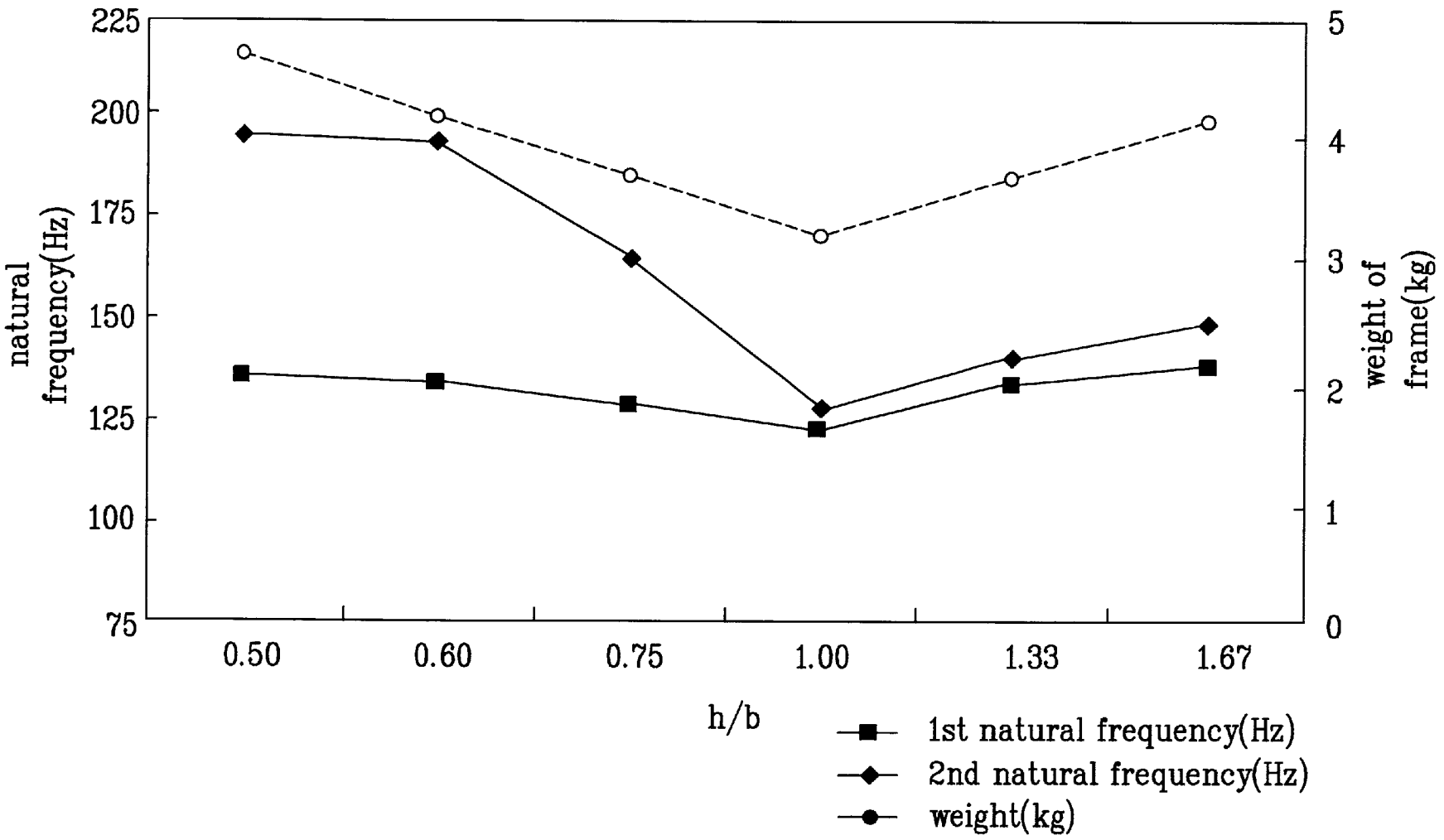
FIG. 10 illustrates a graph showing a height to width ratio(h/b) of a subframe versus natural frequency and weight of the frame assembly; and, FIG. 11 illustrates a graph showing a comparison of resonance frequency ranges of the frame assembly and the shadow mask in the present invention.
Figure 11:
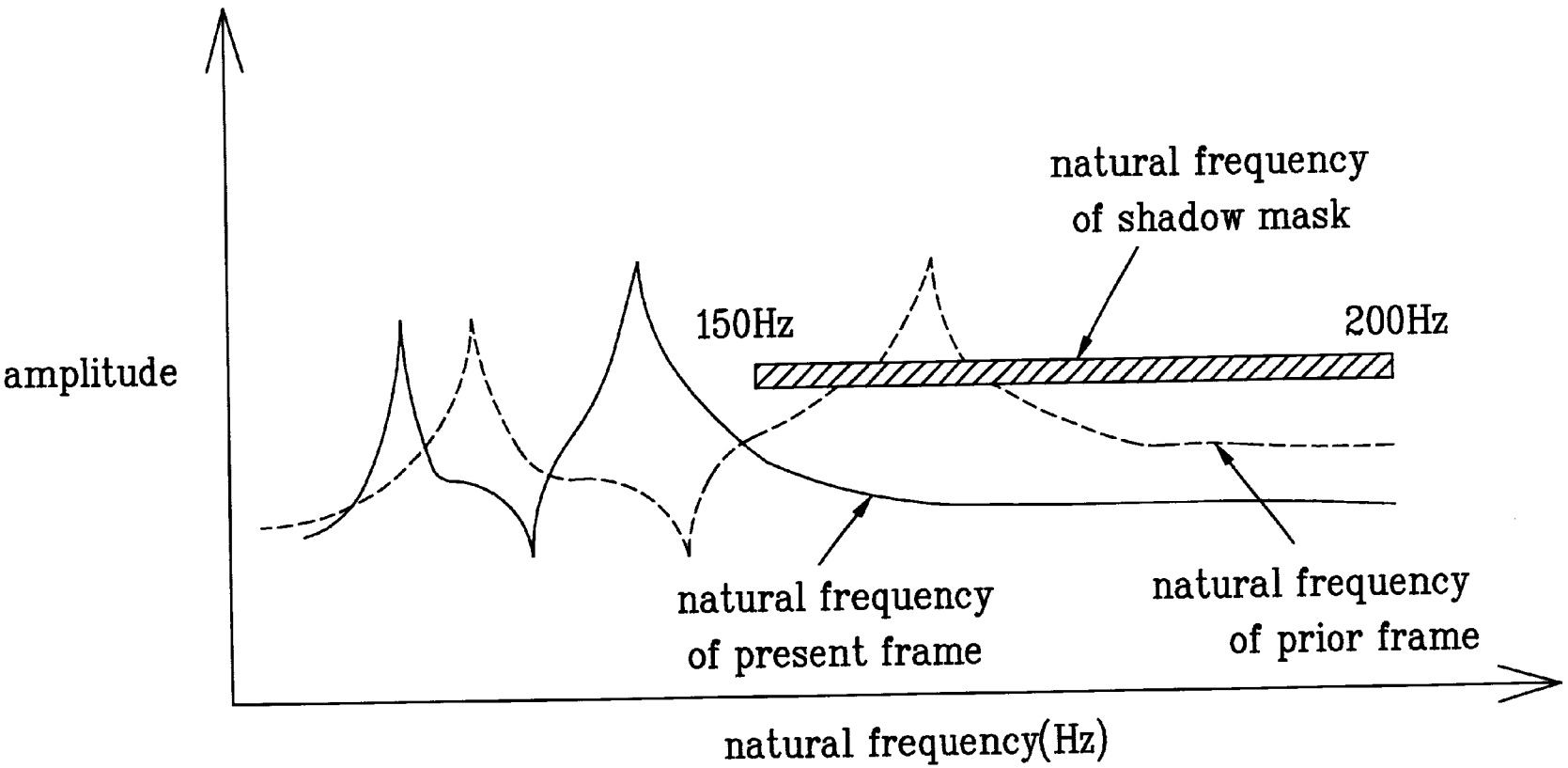

Reference will now be made in detail to the preferred embodiments of the present invention, examples of which are illustrated in the accompanying drawings. FIG. 8 illustrates a solid rectangular section of a subframe with inertial coordinate axes set thereon, FIG. 9 illustrates a graph showing a ratio(Ixx/Izz) of second moment of inertias of a subframe versus natural frequency and weight of the frame assembly, FIG. 10 illustrates a graph showing a height to width ratio(h/b) of a subframe versus natural frequency and weight of the frame assembly, and FIG. 11 illustrates a graph showing a comparison of resonance frequency ranges of the frame assembly and the shadow mask in the present invention.

In the present invention, the spring 8 for supporting the frame assembly and the main frame 7*a* for supporting the shadow mask 3 have the same structure as in the related art. The present invention suggests optimization of a ratio(Ixx/Izz) of second moment of inertia of a subframe, an elastic supporter for applying a tension to the shadow mask 3, for driving a resonance range of the second vibration mode, the twisting mode, of the frame assembly out of 150~200 Hz. That is, the flat cathode ray tube of the present invention includes a panel glass I having a fluorescent material coated on an inside surface, a funnel glass 2 fixed to rear of the panel glass 1 having a neck portion formed as one unit with an electron gun sealed therein for emission of electron beams 6 toward the fluorescent material, a deflection yoke 5 fitted on an outer circumference of the neck portion for deflection of the electron beams 6 emitted from the electron gun, a shadow mask 3 fitted to an inside surface of the panel glass 1 having a plurality of apertures for selecting colors, and a frame assembly 7 having a main frame 7*a* fitted to the shadow mask 3 and a subframe 7*b* connecting both ends of the main frame 7*a,* wherein a ratio of second moment of inertia(Ixx/Izz) of the subframe 7*b* is designed to be within 0.5~2.7 for avoiding a resonance between the frame assembly 7 and the shadow mask 3. When the subframe 7*b* has a solid rectangular section, a height/breadth(h/b) ratio in a range of 0.7~1.6 provides the second moment of inertia in the range of 0.5~0.7.

The action of the frame assembly in a flat cathode ray tube of the present invention will be explained. The second moment of inertia is a resistive capability against deformation, particularly to bending. Therefore, if the rigidity of the frame assembly 7 is made greater, though the second moment of inertia of the frame assembly 7 becomes greater, that drives the natural frequency of the frame assembly out of the resonance frequency range of the shadow mask 3, to permit avoidance of the resonance between the frame assembly 7 and the shadow mask 3, weight of the frame assembly increases, excessively. According to this, calculation of an optimal range of ratio of second moment inertias of the subframe 7*b* is required, in which, while the weight of the frame assembly 7 falls on an appropriate range, a range of natural frequency at which the second vibration mode of the frame assembly occurs is made different from the frequency range of the shadow mask 3. That is, as a vibration higher than 200 Hz does not matter much in the flat cathode ray tube, in the present invention, the ratio of second moment of inertias of the subframe 7*b* is calculated for avoiding resonance at 150~200 Hz. If it is assumed that Ixx denotes a second moment of inertia with respect to an X-axis passing through a center c of the section of the subframe 7*b* in a horizontal direction, and Izz denotes a second moment of inertia with respect to a Z-axis passing through a center c of the section of the subframe 7*b* in a vertical direction, a calculation of the natural frequency of the frame assembly 7 while varying a ratio of the Ixx to Izz provides the following result shown in TABLE 1, below.

TABLE 1

| Ixx/Izz | 0.25 | 0.36 | 0.56 | 1.00 | 1.78 | 2.78 |
|---|---|---|---|---|---|---|
| lst natural frequency(Hz) | 135 | 133 | 128 | 122 | 134 | 139 |
| 2nd natural frequency(Hz) | 196 | 195 | 156 | 128 | 141 | 150 |
| weight(kg) | 4.7 | 4.2 | 3.7 | 3.2 | 3.7 | 4.2 |

Referring to table 1 and FIG. 9, when the ratio of second moment inertias of the subframe 7*b* ranges 0.5~2.7, it can be known that the natural frequency of the second vibration mode of the frame assembly can avoid a 150~200 Hz range, the resonance range of the shadow mask 3, and the weight of the frame assembly also falls within an appropriate range(i.e., below 4 Kg).

In the meantime, the following table 2 shows an optimal range of height to breadth ratio of a solid rectangular subframe section, which can provide the second moment of inertia shown in table 1.

TABLE 2

| h/b | 0.50 | 0.60 | 0.75 | 1.00 | 1.33 | 1.67 |
|---|---|---|---|---|---|---|
| Ixx/Izz | 0.25 | 0.36 | 0.56 | 1.00 | 1.78 | 2.78 |
| lst natural frequency(Hz) | 135 | 133 | 128 | 122 | 134 | 139 |
| 2nd natural frequency(Hz) | 196 | 195 | 156 | 128 | 141 | 150 |
| weight(kg) | 4.7 | 4.2 | 3.7 | 3.2 | 3.7 | 4.2 |

That is, as can be known from TABLE 2 that, when the height to breadth ratio h/b of a solid rectangular section of the subframe 7*b* falls in a range of 10.7~1.6, since the frequency range in which the shearing mode, a second vibration mode, of the frame assembly 7 occurs is in a range lower than 150 Hz as shown in FIG. 11, it can be known that the resonance range of 150~200 Hz of the shadow mask 3 can be avoided. In summary, by designing the ratio of second moment of inertias of the subframe 7*b* forming the frame assembly 7 together with the main frame 7*a* to be within a range in which the frame assembly and the shadow mask 3 make no resonance, the shadow mask howling, a mask vibration, can be prevented.

In the meantime, though the table 2 shows a range of height to breadth ratios of a solid rectangular section of the subframe 7*b* in which the second vibration mode of the frame assembly is made to occur in a frequency range in which resonance between the frame assembly 7 and the shadow mask 3 can be avoided, it is apparent that even a hallow rectangular section can be made such that the ratio Ixx/Izz of the second moment inertias falls within the range of 0.5~2.7 by varying height and breadth, and even an oval section can also be made such that the ratio Ixx/Izz of the second moment inertias falls within the range of 0.5~2.7 by varying a long axis and a short axis.

Thus, by optimizing a ratio of second moment of inertias of a subframe forming a frame assembly with a main frame, the frame assembly in a flat cathode ray tube of the present invention can make a second vibration mode natural frequency to avoid a resonance frequency range with the shadow mask under a state weight of the frame assembly is within an appropriate range, which prevent howling of the shadow mask, thereby enhancing a product reliability of the flat cathode ray tube.

It will be apparent to those skilled in the art that various modifications and variations can be made in the frame assembly in a flat cathode ray tube of the present invention without departing from the spirit or scope of the invention. Thus, it is intended that the present invention cover the modifications and variations of this invention provided they come within the scope of the appended claims and their equivalents.

What is claimed is:

1. A frame assembly in a flat cathode ray tube, the flat cathode ray tube comprising:

a panel glass having a fluorescent material coated on an inside surface;

a funnel glass fixed to rear of the panel glass having a neck portion formed as one unit with an electron gun sealed therein for emission of electron beams toward the fluorescent material;

a deflection yoke fitted on an outer circumference of the neck portion for deflection of the electron beams emitted from the electron gun;

a shadow mask fitted to an inside surface of the panel glass having a plurality of apertures for selecting colors; and, a frame assembly having a main frame with the shadow mask fitted thereto and a subframe connecting both ends of the main frame, wherein a ratio of second moment of inertia(Ixx/Izz) of the subframe is designed to be within a 0.5~2.7 range for avoiding a resonance between the frame assembly and the shadow mask.

2. A frame assembly as claimed in claim 1, wherein the 0.5~2.7 range corresponds to a 0.7~1.6 height to breadth range(h/b) of the subframe when the subframe has a solid rectangular section.

3. A frame assembly as claimed in claim 1, wherein the 0.5~2.7 range can be met with a hollow rectangular section or oval section of the subframe.

* * * * *